US007278225B1

(12) United States Patent
Espinosa

(10) Patent No.: US 7,278,225 B1
(45) Date of Patent: Oct. 9, 2007

(54) FOOT DRYING DEVICE

(76) Inventor: Roman Espinosa, 3641 SW. Masilunas St., Port Saint Lucie, FL (US) 34953

( * ) Notice: Subject to any disclaimer, the term of this patent is extended or adjusted under 35 U.S.C. 154(b) by 0 days.

(21) Appl. No.: 11/546,708

(22) Filed: Oct. 13, 2006

(51) Int. Cl.
*F26B 19/00* (2006.01)

(52) U.S. Cl. ..... 34/90; 34/202; 34/233; 392/380

(58) Field of Classification Search ..... 34/90, 34/91, 202, 218, 231–235; 392/379, 380, 392/382, 383
See application file for complete search history.

(56) References Cited

U.S. PATENT DOCUMENTS 2,779,856 A * 1/1957 Fahner ..... 392/382
3,378,009 A 4/1968 Peplin
4,782,601 A * 11/1988 Gonzalez ..... 34/233
D300,960 S 5/1989 Billings
5,438,764 A 8/1995 Reppas et al.
5,491,908 A * 2/1996 Ruiz et al. ..... 34/202
5,819,431 A 10/1998 Lancer
5,826,347 A 10/1998 Olivares-Gonzalea de Serrano
6,705,023 B1 3/2004 Hoover

* cited by examiner

*Primary Examiner*—Jiping Lu

(57) ABSTRACT

A foot-drying device includes a body including first and second vertical sides, and an open front face sloping upward away from a front edge thereof. The body is hollow, forming a chamber that extends from a bottom surface to a top surface thereof, and has a rear panel hingedly coupled thereto. A foot pad is seated over the open front face and is provided with apertures for draining water therethrough. A mechanism is included for diverting the water outwardly from the chamber as the water drips down through the apertures of the foot pad. A mechanism is included for introducing heated air into the chamber such that the heated air is quickly engaged with the user foot. The heated air is evenly discharged from the apertures such that the water on the user foot is completely expelled away therefrom. The air heating mechanism is disposed above the water diverting mechanism.

12 Claims, 4 Drawing Sheets

FOOT DRYING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to drying devices and, more particularly, to a foot drying device for quickly drying a user foot when same has become wet.

2. Prior Art

The prevention and cure of athlete's foot (mycosis) and verrucas on the soles of the feet (two of the ten most common skin complaints in this field), require constant, lengthy and costly treatment by a dermatologist. Athlete's foot and verrucas are very easily transmitted, given the physical and biochemical characteristics of the microorganisms that cause them (fungi and viruses of this nature develop in the presence of moisture). These infections recur frequently and are difficult to treat with conventional means based on creams, topical solutions of imidazolic derivatives, oral medication, etc., which, although effective, are long and relatively costly.

Moisture on the feet plays a very important role in the transmission of the condition. As such, easy and thorough drying of the feet is fundamental to its treatment, in order to prevent the transmission of microorganisms and help in the eradication of the cause. Proper drying can actually help both in the prevention and the cure. Since humidity offers the ideal condition for their multiplication, drying of the feet is one of the principal recommendations in the treatment of different cases of the above mentioned diseases, taking into account that the causative, agents are very unstable in a warm, dry environment.

Although most individuals can take the drying of their feet for granted, there are some that find this task much more difficult than what it seems at face value. For instance, a person suffering from severe back pain will find it rather difficult to bend over in attempt to reach their toes. Similarly, a pregnant woman may also find that bending to reach her toes for drying purposes is not an easy task. Often, people in these situations need the assistance of a second individual for proper drying of their feet.

In an attempt to alleviate this problem a number of automatic foot drying devices have been introduced into the prior art. One prior art invention shows a device that dries feet by means of passing hot air onto the user's feet. Such a device includes an upper and a lower chamber. This lower chamber houses the ventilating mechanism which has an air intake for the fan that is driven by an electric motor fed by a cable. Such a fan effectively generates the draft necessary for the drier to work. Unfortunately, airflow only passes over the soles of the user's feet, neglecting, for the most part, the upper portions and toes of the feet. Thus the device does not perform a thorough drying job, especially when one considers that the areas between the toes are most susceptible to bacterial, viral and fungal growths.

Accordingly, a need remains for a foot drying device in order to overcome the above-noted shortcomings. The present invention satisfies such a need by providing a foot drying device that is convenient and easy to use, is light weight yet durable in design, is versatile in its applications, and is effective for drying an entire surface area of the user's feet. Such a device releases hot or cool air to thoroughly and completely dry the person's feet, and serves as a time- and energy-saving alternative to conventional methods of drying feet, like toweling.

The device advantageously eliminates the need to bend over or lift feet to dry them with a towel, which can be particularly beneficial to the elderly, physically impaired individuals, and pregnant women, to name a few.

BRIEF SUMMARY OF THE INVENTION

In view of the foregoing background, it is therefore an object of the present invention to provide a foot drying device. These and other objects, features, and advantages of the invention are provided by a pneumatically-operated foot-drying device for quickly drying a user foot.

The foot-drying device includes a body including first and second vertically oriented sides extending upward from a ground surface. Such a body further includes an open front face distally sloping upward away from a front edge of the body. The body is hollow and forms a chamber that extends from a bottom surface to a top surface of the body. Such a body further has a rear panel hingedly coupled thereto for advantageously and effectively allowing the user to access the chamber without detaching the foot pad from the open front face.

The body may further include a linear shoulder that is monolithically formed with the bottom surface and projects upwardly therefrom. Such a shoulder is rearwardly offset from the front edge. The front edge has a plurality of openings formed at a height below a top lip of the shoulder. The flexible pad has a slot formed at a bottom proximal end seated medially of the openings and the shoulder such that water is effectively deposited into a cavity defined therebetween. The water conveniently exits the cavity via the openings without rearwardly traveling beyond the shoulder.

A flexible foot pad is removably seated over the open front face. Such a foot pad is formed from non-corrosive material and further is provided with a plurality of apertures formed therein for effectively and conveniently draining water away from the user foot.

A mechanism is included for diverting the water outwardly from the chamber as the water drips down through the apertures of the foot pad. Such a water diverting mechanism is spaced subjacent to the foot pad and remains stationary while the foot pad is detached from the open front face. The water diverting mechanism may include a flexible pad formed from water-repelling material. Such a flexible pad is completely housed within the chamber and lays subjacent to the foot pad. The flexible pad is conveniently removable from the chamber and has a longitudinal length shorter than a longitudinal length of the foot pad.

The water diverting mechanism preferably further includes a plurality of flanges that are monolithically formed with an inner surface of the chamber. The flanges are spaced along a longitudinal length of the water-repelling member and further are vertically offset along a direction sloping downward toward a front edge of the body such that the flexible pad is maintained at a bowed and downwardly sloping position for conveniently and effectively channeling the water towards the front edge.

A mechanism is included for introducing a predetermined volume of heated air into the chamber such that the heated air effectively travels along a passageway bifurcating the foot pad and the water diverting mechanism such that the heated air is advantageously quickly and effectively engaged with the user foot after leaving the air heating mechanism. Such heated air is evenly discharged out from the apertures of the foot pad such that the water residing on the user foot is advantageously and effectively expelled away therefrom and channeled downwardly onto the water diverting mechanism for drainage. The air heating mechanism is disposed above the water diverting mechanism.

The air heating mechanism preferably includes a user control panel that is mounted at a top end of the body. A helical heating element has a longitudinal axis vertically registered within the chamber and subjacent to the top end of the body. A motorized fan is electrically coupled to the heating element. The body has a vented opening formed in a back face thereof. Such a vented opening is aligned with the motorized fan such that ambient air is advantageously and effectively channeled into the chamber and traversed through the heating element prior to reaching the passageway.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
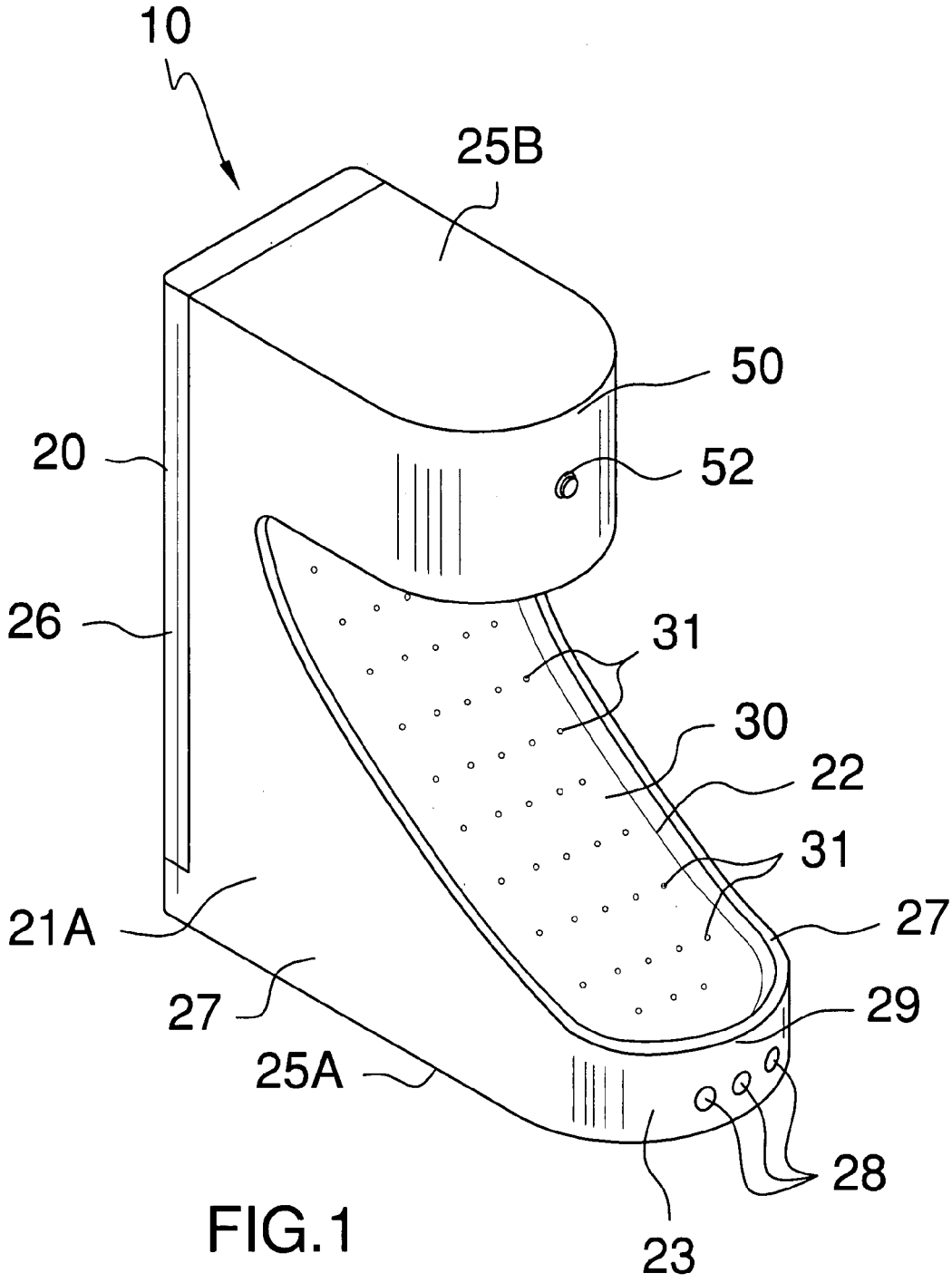
FIG. 1 is a perspective view showing a foot drying device, in accordance with the present invention.
Figure 2:
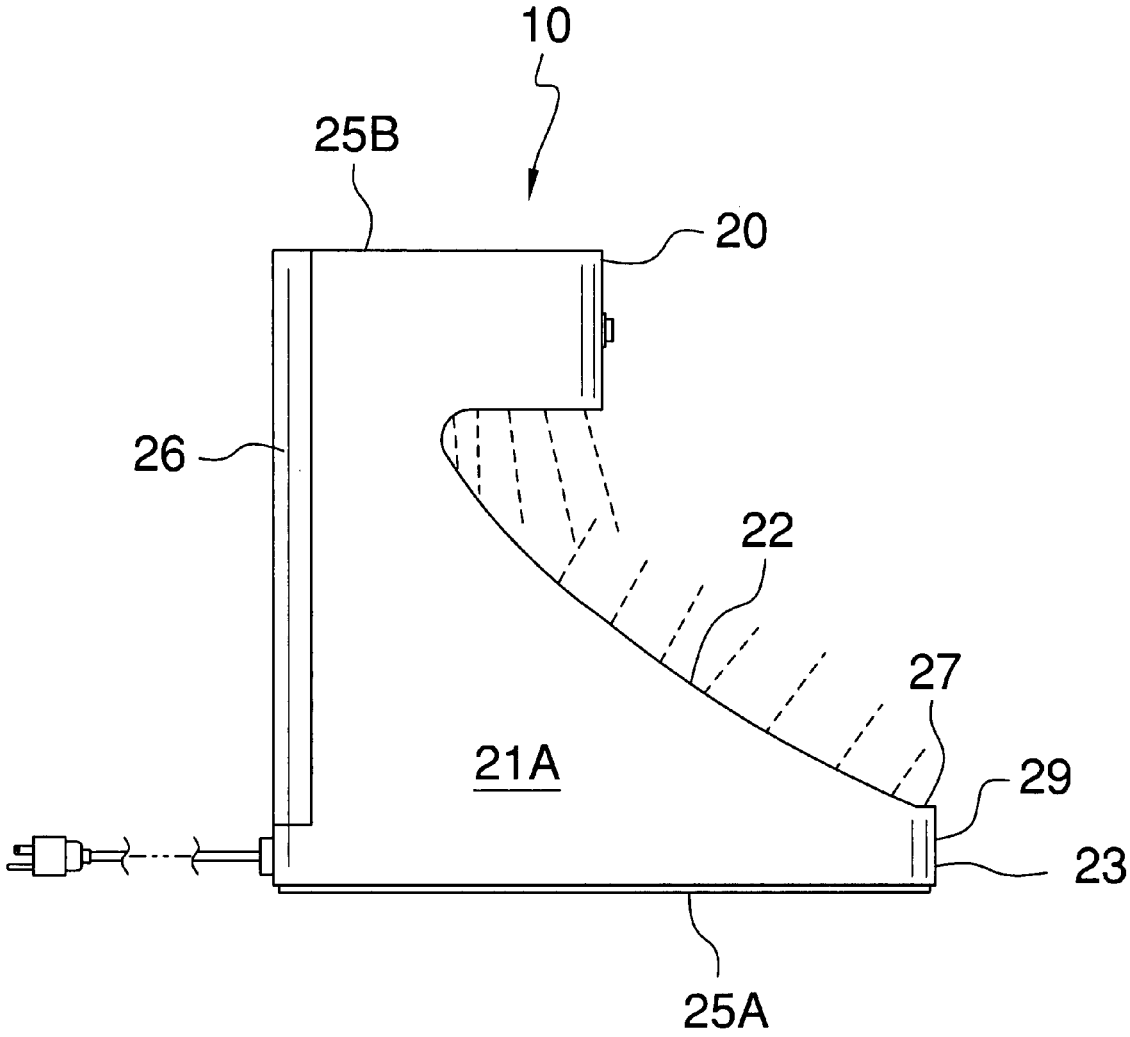
FIG. 2 is a side-elevational view of the device shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-5 by the reference numeral 10 and is intended to provide a foot drying device. It should be understood that the device 10 may be used to dry many different types of body parts or other objects, and should not be limited in use to only drying one's feet.

Figure 3:
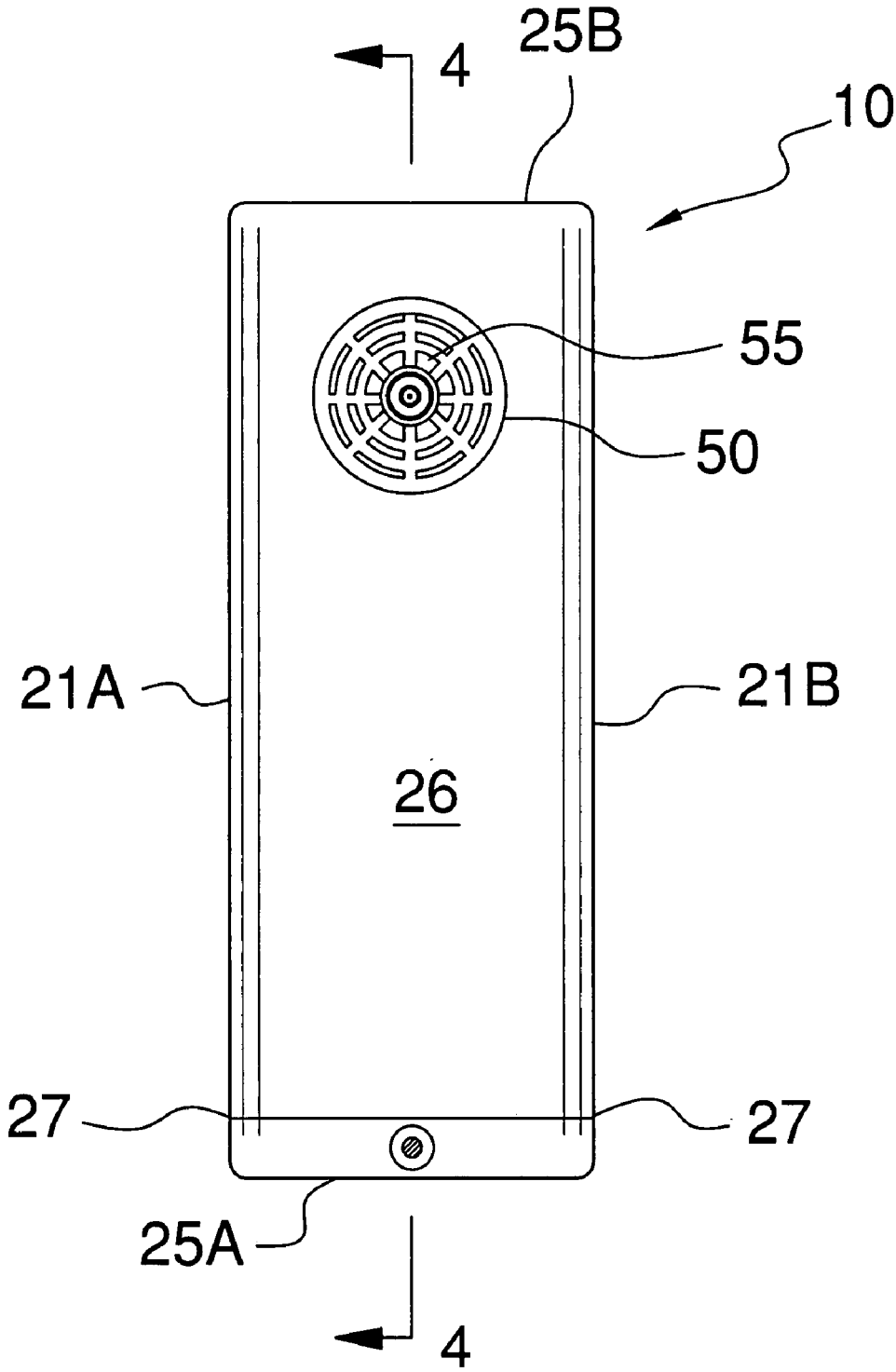
FIG. 3 is a rear-elevational view of the device shown in FIG. 2, viewed along line 3-3.
Figure 4:
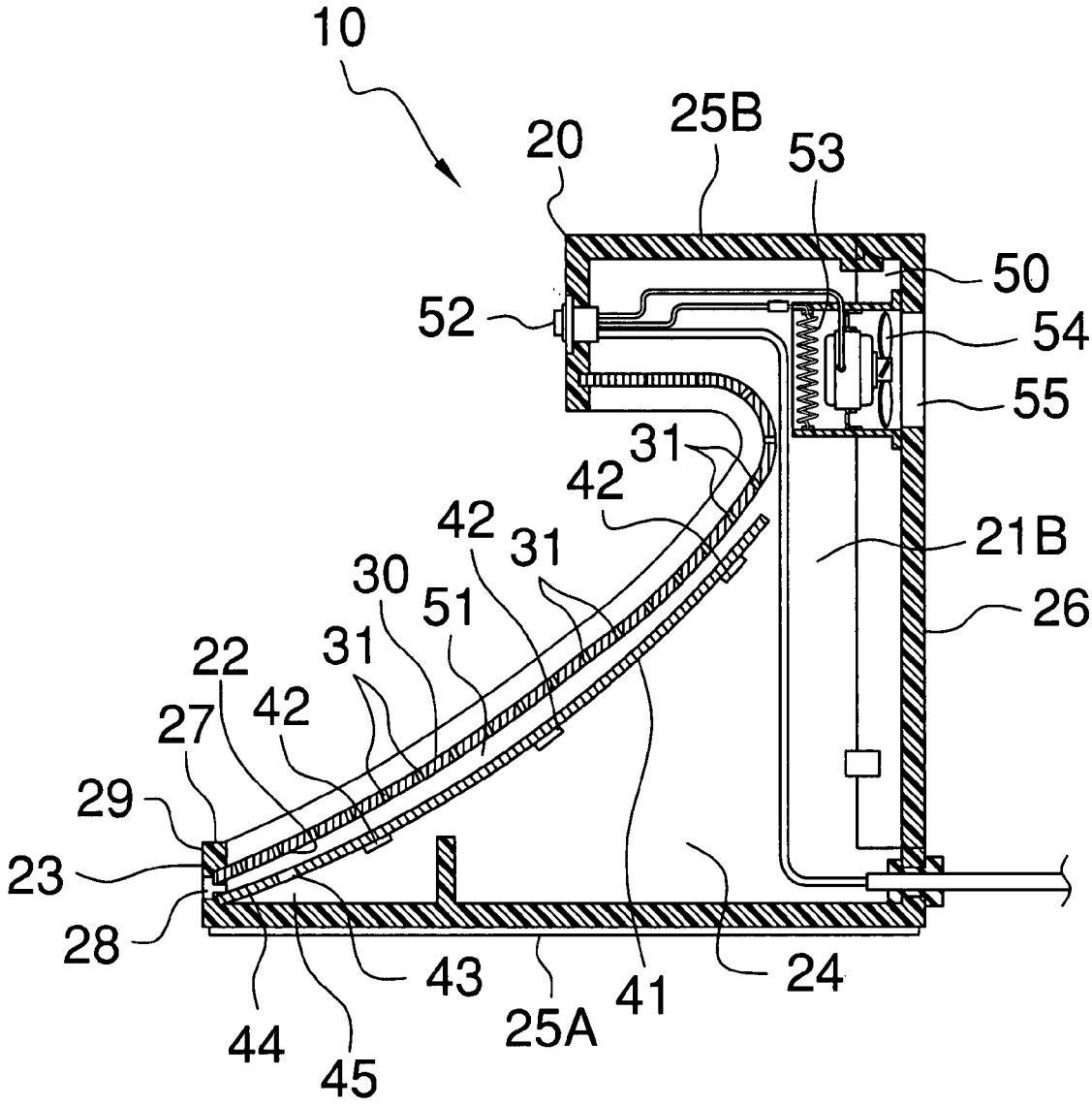
FIG. 4 is a cross-sectional view of the device shown in FIG. 3, taken along line 44, and showing the water diverting mechanism air heating mechanism housed within the body.

Referring initially to FIGS. 1, 2, 3 and 4, the device 10 includes a body 20 including first 21A and second 21B vertically oriented sides extending upward from a ground surface. Such a body 20 further includes an open front face 22 distally sloping upward away from a front edge 23 of the body 20. The body 20 is hollow and forms a chamber 24 that extends from a bottom surface 25A to a top surface 25B of the body 20, as is best shown in FIG. 4. Of course, the body 20 may be produced in a variety of different shapes, sizes and colors depending on the user's needs, as is obvious to a person of ordinary skill in the art. Such a body 20 further has a rear panel 26 hingedly coupled thereto that is vital for advantageously and effectively allowing the user to access the chamber 24 without detaching the foot pad 30 (described herein below) from the open front face 22.

Again referring FIGS. 1 through 4, the body 20 further includes a linear shoulder 27 that is monolithically formed with the bottom surface 25A and projects upwardly therefrom. Such a shoulder 27 is rearwardly offset from the front edge 23. The front edge 23 has a plurality of openings 28 formed at a height below a top lip 29 of the shoulder 27. The flexible pad 41 (described herein below) has a slot 43 formed at a bottom proximal end 44 seated medially of the openings 28 and the shoulder 27, which is essential and advantageous such that water is effectively deposited into a cavity 45 defined therebetween. The water conveniently exits the cavity 45 via the openings 28 without rearwardly traveling beyond the shoulder 27.

Referring to FIGS. 1, 3 and 4, a flexible, preferably deformably resilient, foot pad 30 is removably seated over the open front face 22. Such a foot pad 30 is formed from non-corrosive material and further is provided with a plurality of apertures 31 formed therein that are critical for effectively and conveniently draining water away from the user's foot. Of course, the foot pad 30 may be produced from a variety of suitable materials and in a number of different sizes for meeting a user's specific needs, as is obvious to a person of ordinary skill in the art.

Referring to FIG. 4, a mechanism 40 is included for diverting the water outwardly from the chamber 24 as the water drips down through the apertures 31 of the foot pad 30. Such a water diverting mechanism 40 is spaced subjacent to the foot pad 30 and remains stationary while the foot pad 30 is detached from the open front face 22. The water diverting mechanism 40 includes a flexible pad 41 formed from water-repelling material, which is important for preventing fluid from accumulating within the device 10. Such a flexible pad 41 is completely housed within the chamber 24 and lays subjacent to the foot pad 30, thus allowing water from the user's feet to directly drain onto the flexible pad 41.

The flexible pad 41 is conveniently removable from the chamber 24 and has a longitudinal length shorter than a longitudinal length of the foot pad 30. The water diverting mechanism 40 further includes a plurality of flanges 42 that are monolithically formed with an inner surface of the chamber 24, as illustrated in FIG. 4. The flanges 42 are spaced along a longitudinal length of the water-repelling member 41 and further are vertically offset along a direction sloping downward toward the front edge 23 of the body 20, which is important such that the flexible pad 41 is maintained at a bowed and downwardly sloping position for conveniently and effectively channeling the water towards the front edge 23.

Referring to FIGS. 1, 3 and 4, a mechanism 50 is included for introducing a predetermined volume of heated air into the chamber 24 such that the heated air effectively travels along a passageway 51 bifurcating the foot pad 30 and the water diverting mechanism 40, which is critical such that the heated air is advantageously quickly and effectively engaged with the user's foot after leaving the air heating mechanism 50. Such heated air is evenly discharged out from the apertures 31 of the foot pad 30, which is important such that the water residing on the user's foot is advantageously and effectively expelled away therefrom and channeled downwardly onto the water diverting mechanism 40 for drainage. The air heating mechanism 50 is disposed above the water diverting mechanism 50.

Still referring to FIGS. 1, 3 and 4, such an air heating mechanism 50 includes a user control panel 52 that is mounted at a top end 25B of the body. A helical heating element 53 has a longitudinal axis vertically registered within the chamber 24 and subjacent to the top end 25B of the body 20. A motorized fan 54 is electrically coupled to the heating element 53. The body 20 has a vented opening 55 formed in a back face thereof, as is best shown in FIG. 4. Such a vented opening 55 is aligned with the motorized fan 54, which is essential such that ambient air is advantageously and effectively channeled into the chamber 24 and traversed through the heating element 53 prior to reaching the passageway 51.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A pneumatically-operated foot-drying device for quickly drying a user foot, said foot-drying device comprising:

a body including first and second vertically oriented sides extending upward from a ground surface, said body further including an open front face distally sloping upward away from a front edge of said body, said body being hollow and forming a chamber extending from a bottom surface to a top surface of said body;

a flexible foot pad removably seated over said open front face, said foot pad being formed from non-corrosive material and further being provided with a plurality of apertures formed therein for draining water away from the user foot;

means for diverting the water outwardly from said chamber as the water drips down through said apertures of said foot pad, said water diverting means being spaced subjacent to said foot pad and remaining stationary while said foot pad is detached from said open front face; and means for introducing a predetermined volume of heated air into said chamber such that said heated air travels along a passageway bifurcating said foot pad and said water diverting means such that said heated air is quickly and effectively engaged with the user foot after leaving said air heating means, said heated air being evenly discharged out from said apertures of said foot pad such that the water residing on the user foot is expelled away therefrom and channeled downwardly onto said water diverting means for drainage;

wherein said water diverting means comprises a flexible pad formed from water-repelling material, said flexible pad being completely housed within said chamber and laying subjacent to said foot pad, said flexible pad being removable from said chamber and having a longitudinal length shorter than a longitudinal length of said foot pad.

2. The device of claim 1, wherein said air heating means comprises:

a user control panel mounted at a top end of said body;

a helical heating element having a longitudinal axis vertically registered within said chamber and disposed subjacent to said top end of said body; and a motorized fan electrically coupled to said heating element;

wherein said body has a vented opening formed in a back face thereof, said vented opening being aligned with said motorized fan such that ambient air is effectively channeled into said chamber and traversed through said heating element prior to reaching said passageway.

3. The device of claim 1, wherein said water diverting means further comprises: a plurality of flanges monolithically formed with an inner surface of said chamber, said flanges being spaced along a longitudinal length of said water-repelling member and further being vertically offset along a direction sloping downward toward a front edge of said body such that said flexible pad is maintained at a bowed and downwardly sloping position for channeling the water towards said front edge.

4. The device of claim 1, wherein said body further includes a linear shoulder monolithically formed with said bottom surface and projecting upwardly therefrom, said shoulder being rearwardly offset from said front edge, said front edge having at least one opening formed at a height below a top lip of said shoulder, said flexible pad having a slot formed at a bottom proximal end seated medially of said openings and said shoulder such that water is deposited into a cavity defined therebetween, said water exiting said cavity via said openings without rearwardly traveling beyond said shoulder.

5. A pneumatically-operated foot-drying device for quickly drying a user foot, said foot-drying device comprising:

a body including first and second vertically oriented sides extending upward from a ground surface, said body further including an open front face distally sloping upward away from a front edge of said body, said body being hollow and forming a chamber extending from a bottom surface to a top surface of said body;

a flexible foot pad removably seated over said open front face, said foot pad being formed from non-corrosive material and further being provided with a plurality of apertures formed therein for draining water away from the user foot;

means for diverting the water outwardly from said chamber as the water drips down through said apertures of said foot pad, said water diverting means being spaced subjacent to said foot pad and remaining stationary while said foot pad is detached from said open front face; and means for introducing a predetermined volume of heated air into said chamber such that said heated air travels along a passageway bifurcating said foot pad and said water diverting means such that said heated air is quickly and effectively engaged with the user foot after leaving said air heating means, said heated air being evenly discharged out from said apertures of said foot pad such that the water residing on the user foot is expelled away therefrom and channeled downwardly onto said water diverting means for drainage, wherein said air heating means is disposed above said water diverting means;

wherein said water diverting means comprises a flexible pad formed from water-repelling material, said flexible pad being completely housed within said chamber and laying subjacent to said foot pad, said flexible pad being removable from said chamber and having a longitudinal length shorter than a longitudinal length of said foot pad.

6. The device of claim 5, wherein said air heating means comprises:

a user control panel mounted at a top end of said body;

a helical heating element having a longitudinal axis vertically registered within said chamber and subjacent to said top end of said body; and a motorized fan electrically coupled to said heating element;

wherein said body has a vented opening formed in a back face thereof, said vented opening being aligned with said motorized fan such that ambient air is effectively channeled into said chamber and traversed through said heating element prior to reaching said passageway.

7. The device of claim 5, wherein said water diverting means further comprises:

a plurality of flanges monolithically formed with an inner surface of said chamber, said flanges being spaced along a longitudinal length of said water-repelling member and further being vertically offset along a direction sloping downward toward a front edge of said body such that said flexible pad is maintained at a bowed and downwardly sloping position for channeling the water towards said front edge.

8. The device of claim 5, wherein said body further includes a linear shoulder monolithically formed with said bottom surface and projecting upwardly therefrom, said shoulder being rearwardly offset from said front edge, said front edge having at least one opening formed at a height below a top lip of said shoulder, said flexible pad having a slot formed at a bottom proximal end seated medially of said openings and said shoulder such that water is deposited into a cavity defined therebetween, said water exiting said cavity via said openings without rearwardly traveling beyond said shoulder.

9. A pneumatically-operated foot-drying device for quickly drying a user foot, said foot-drying device comprising:

a body including first and second vertically oriented sides extending upward from a ground surface, said body further including an open front face distally sloping upward away from a front edge of said body, said body being hollow and forming a chamber extending from a bottom surface to a top surface of said body, wherein said body has a rear panel hingedly coupled thereto for allowing the user to access said chamber without detaching said foot pad from said open front face;

a flexible foot pad removably seated over said open front face, said foot pad being formed from non-corrosive material and further being provided with a plurality of apertures formed therein for draining water away from the user foot;

means for diverting the water outwardly from said chamber as the water drips down through said apertures of said foot pad, said water diverting means being spaced subjacent to said foot pad and remaining stationary while said foot pad is detached from said open front face; and means for introducing a predetermined volume of heated air into said chamber such that said heated air travels along a passageway bifurcating said foot pad and said water diverting means such that said heated air is quickly and effectively engaged with the user foot after leaving said air heating means, said heated air being evenly discharged out from said apertures of said foot pad such that the water residing on the user foot is expelled away therefrom and channeled downwardly onto said water diverting means for drainage, wherein said air heating means is disposed above said water diverting means;

wherein said water diverting means comprises a flexible pad formed from water-repelling material, said flexible pad being completely housed within said chamber and laying subjacent to said foot pad, said flexible pad being removable from said chamber and having a longitudinal length shorter than a longitudinal length of said foot pad.

10. The device of claim 9, wherein said air heating means comprises:

a user control panel mounted at a top end of said body;

a helical heating element having a longitudinal axis vertically registered within said chamber and subjacent to said top end of said body; and a motorized fan electrically coupled to said heating element;

wherein said body has a vented opening formed in a back face thereof, said vented opening being aligned with said motorized fan such that ambient air is effectively channeled into said chamber and traversed through said heating element prior to reaching said passageway.

11. The device of claim 9, wherein said water diverting means further comprises:

a plurality of flanges monolithically formed with an inner surface of said chamber, said flanges being spaced along a longitudinal length of said water-repelling member and further being vertically offset along a direction sloping downward toward a front edge of said body such that said flexible pad is maintained at a bowed and downwardly sloping position for channeling the water towards said front edge.

12. The device of claim 9, wherein said body further includes a linear shoulder monolithically formed with said bottom surface and projecting upwardly therefrom, said shoulder being rearwardly offset from said front edge, said front edge having at least one f opening formed at a height below a top lip of said shoulder, said flexible pad having a slot formed at a bottom proximal end seated medially of said openings and said shoulder such that water is deposited into a cavity defined therebetween, said water exiting said cavity via said openings without rearwardly traveling beyond said shoulder.

* * * * *